US009340060B2

(12) United States Patent
Cheon

(10) Patent No.: US 9,340,060 B2
(45) Date of Patent: May 17, 2016

(54) SLIDE TYPE WRITING TOOL HAVING DEVICE FOR PREVENTING DRYNESS

(71) Applicant: Kwang Ju Cheon, Kyunggi-do (KR)

(72) Inventor: Kwang Ju Cheon, Kyunggi-do (KR)

( * ) Notice: Subject to any disclaimer, the term of this patent is extended or adjusted under 35 U.S.C. 154(b) by 0 days.

(21) Appl. No.: 14/572,513

(22) Filed: Dec. 16, 2014

(65) Prior Publication Data

US 2015/0224812 A1 Aug. 13, 2015

(30) Foreign Application Priority Data

Feb. 10, 2014 (KR) ..... 10-2014-0014872

(51) Int. Cl.

| | |
|---|---|
| ***B43K 7/12*** | (2006.01) |
| ***B43K 8/02*** | (2006.01) |
| ***B43K 24/08*** | (2006.01) |
| ***B43K 8/03*** | (2006.01) |
| ***B43K 8/24*** | (2006.01) |
| ***B43K 25/02*** | (2006.01) |

(52) U.S. Cl.

CPC . *B43K 8/028* (2013.01); *B43K 8/03* (2013.01); *B43K 8/24* (2013.01); *B43K 24/08* (2013.01); *B43K 25/028* (2013.01)

(58) Field of Classification Search

CPC ..... B43K 8/028; B43K 8/03; B43K 8/24; B43K 24/08

USPC ..... 401/107–108

See application file for complete search history.

(56) References Cited

U.S. PATENT DOCUMENTS

| | | | | |
|---|---|---|---|---|
| 6,981,812 | B1 * | 1/2006 | Hsieh | B43K 8/028 401/107 |
| 7,931,416 | B2 * | 4/2011 | Yoon | B43K 5/17 401/107 |
| 8,177,447 | B2 * | 5/2012 | Yoon | B43K 5/17 401/107 |
| 8,215,857 | B2 * | 7/2012 | Carroll | A45D 40/02 401/107 |
| 8,393,814 | B2 * | 3/2013 | Challman | B43K 8/028 401/108 |
| 2010/0322697 | A1 * | 12/2010 | Rolion | B43K 8/028 401/107 |
| 2011/0103875 | A1 * | 5/2011 | Huang | B43K 8/00 401/104 |

FOREIGN PATENT DOCUMENTS

| | | |
|---|---|---|
| KR | 2019890003644 | 5/1989 |
| KR | 1019950000776 | 2/1995 |

* cited by examiner

*Primary Examiner* — Jennifer C Chiang
(74) *Attorney, Agent, or Firm* — IPLA P.A.; James E. Bame

(57) ABSTRACT

A slide type writing tool includes: a pen housing (10); an ink holder (30); a sealing member (40) having a cover (41); a spring (50) elastically supporting the sealing member (40) and the ink holder (30); and a guide member (60) positioned between the sealing member (40) and the pen housing (10) and having an operation hole (65) for the coming in and out of the pen tip (31) in response to the forward or backward movement of the ink holder (30), wherein the opening and closing operations of the cover (41) of the sealing member (40) are guided when the sealing member (40) moves, the ink holder (30) has cam protrusions (70) for enabling the guide member (60) to move and moving along the operation slits (62), and the sealing member (40) has a sealing portion (42) coming into contact with the ink holder (30) and protrusions (44).

1 Claim, 7 Drawing Sheets

SLIDE TYPE WRITING TOOL HAVING DEVICE FOR PREVENTING DRYNESS

CROSS REFERENCE

The present application claims the benefit of Korean Patent Application No. 10-2014-0014872 filed in the Korean Intellectual Property Office on Feb. 10, 2014, the entire contents of which are incorporated herein by reference.

BACKGROUND

The present invention relates to a slide type writing tool provided with a device for preventing dryness, wherein a pen tip of the writing tool using highly volatile ink such as highlighters, markers, magic markers, plus pens or the like is protruded to the outside just in case of use while being received inside in a sealed state in case of non-use with a simple structure, thereby preventing the evaporation of the ink or the dryness of the pen tip.

In general, writing tools mean magic markers, highlighters, markers or the like in addition to ballpoint pens, and most of them are provided with sealing caps for the prevention of the dryness of the ink.

There are typically several kinds of writing tools, wherein a fixed type writing tool includes a cap used for a fixed pen tip, a rotation type writing tool has a part of a pen core to come out along a spiral pipe by partially rotating a shaft, a nock type writing tool has a pen tip to come in and out along the movement of a spring in response to the pressing of a part of a shaft, and a slide type writing tool has a pen tip sliding to come in and out.

The slide type writing tool has an advantage that a user can use the same without any inconvenience of opening and closing any additional cover. However, the slide type writing tool still has a disadvantage that a pen tip exit hole for the coming in and out of a pen tip is simply penetrated through an end portion at one side of the writing tool such that the writing tool can be limitedly used for non-volatile or weak volatile oil ink or the like.

Meanwhile, marker pens, white pens, water-based pens, highlighters or the like using highly volatile ink or the like have the disadvantages of using the inconvenient opening and closing covers. Further, the pen tips of the above pens using highly volatile ink or the like are likely to be damaged or reduced in the lifespan thereof if the pen tips are exposed to the outside for a long time.

PRIOR ART DOCUMENTS

Patent Document 1: Korean Patent Publication No. 10-1995-0000776, (registered on 26 Jun. 1995)

Patent Document 2: Korean Utility Model Publication No. 20-1989-0003644, (published on 7 Apr. 1989)

SUMMARY OF THE INVENTION

Korean patent publication No. 10-1995-0000776 discloses a writing tool having no cap but provided with a dryness prevention device, wherein a cover for covering a pen tip portion by the tension of a rubber string is opened if a pressing portion of a slide type writing tool is pressed and then the cover is closed so as to seal the pen tip portion if the pressing portion is pressed once again such that the dryness of the ink can be prevented.

However, the prior art still has a disadvantage that the opening and closing of the cover is not carried out in a short time due to the use of the tension of the rubber string. In addition, the prior art writing tool must be complemented in the durability thereof, and the sealing state of the cover which temporarily closes a hole is very weak.

In order to resolve the above problems, Korean utility model publication No. 20-1989-0003644 discloses a writing tool having no cap, wherein a pen tip passes through elastic members provided to an inside barrel so as to be exposed for the use of the pen if a knock portion is pressed, and the pen tip returns to the original position thereof if the knock portion is released or pressed again such that the separated portions of the elastic members come into contact with each other so as to be sealed for the prevention of the dryness of the pen tip.

However, the technique still has a disadvantage that the separated portions of the elastic members can be subjected to plastic deformation and the deterioration of sealing force due to the friction caused by frequent use.

The present invention has been made so as to resolve the above-described disadvantages and any other problems, and its objective is to provide a slide type writing tool having a device for preventing dryness, wherein the exposure and sealing of a pen tip can be carried out by simple operations in a simple structure in such a manner that a cover portion for sealing a pen tip is opened in response to the pressing of a knob so as to push the pen tip to be exposed to the outside and the pen tip is restored to an initial position thereof in the cover while the cover is automatically closed so as to prevent the dryness of the pen tip which is covered by the cover if the knob is released by simple operations in a simple structure.

Another objective of the present invention is to provide a slide type writing tool which can prevent the loss of or damage to a sealing function due to the repetitive use, thereby improving the reliability of products.

In order to achieve the above and any other objectives of the present invention, a slide type writing tool comprises:

a pen housing 10 formed in a cylindrical shape with an empty inside portion and having a pen tip exit hole 11 formed by penetrating a front end portion and a button clip part 20 provided to an upper end at one side;

an ink holder 30 received in the pen housing 10 so as to receive ink therein in a state, in which a pen tip 31 is coupled at the front end thereof and a knob 32 is coupled to the other side thereof;

a sealing member 40 having a cover 41 hinge-connected to the front end thereof so as to be opened or closed according to the forward or backward movement of the ink holder 30 in a state, in which the ink holder 30 receives the pen tip 31, such that the pen tip 31 can come in and out;

a spring 50 elastically supporting the sealing member 40 and the ink holder 30; and a guide member 60 positioned between the sealing member 40 and the pen housing 10 and having an operation hole 65 penetrated so as to enable the pen tip 31 to come in and out in response to the forward or backward movement of the ink holder 30 in a state, in which the sealing member 40 is received in the guide member 60, wherein the cover 41 of the sealing member 40 is guided in a state, in which the cover 41 of the sealing member 40 is fitted into a cam groove 67 of the guide member 60 which is formed to extend from a linear portion 67*a* to an inclined portion 67*b*, such that the opening and closing operations of the cover 41 are guided when the sealing member 40 moves, the guide member 60 has holding parts 61 and operation slits 62 provided to the outside surface thereof along the longitudinal direction thereof, the ink holder 30 has cam protrusions 70 for enabling the guide member 60 to move in a state, in which the cam protrusions 70 come into contact with the holding parts 61 of the guide member 60, and moving along the operation slits 62, and the sealing member 40 has a sealing portion 42 formed to protrude inwards from an inner diameter portion thereof so as to come into contact with the outer diameter portion of the ink holder 30 and protrusions 44 formed to protrude outwards from an outer diameter portion thereof such that a fixing cap 45 to be held by a stepped portion 18 formed on the inside of the pen housing 10 is coupled to the sealing member 40 in such a manner that the protrusions 44 of the sealing member 40 are received in receiving grooves 46 of the fixing cap 45.

According to the present invention in the above configuration, a slide type writing tool can be provided with a device for preventing dryness, wherein the configuration of the constituent elements is simple such that the dryness of the pen tip can be prevented through simple operations.

In addition, the slide type writing tool according to the present invention can prevent the loss of or damage to a sealing function due to the repetitive use, thereby improving the reliability of products.

DETAILED DESCRIPTION OF THE INVENTION

Figure 1:
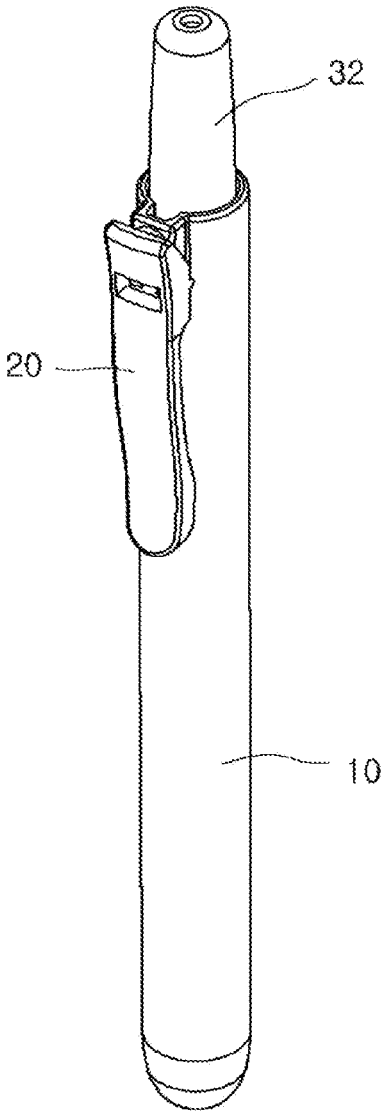
FIG. 1 is a perspective view showing a sealed state of a pen tip of a writing tool according to the present invention, in which the pen tip is maintained inside.
Figure 2:
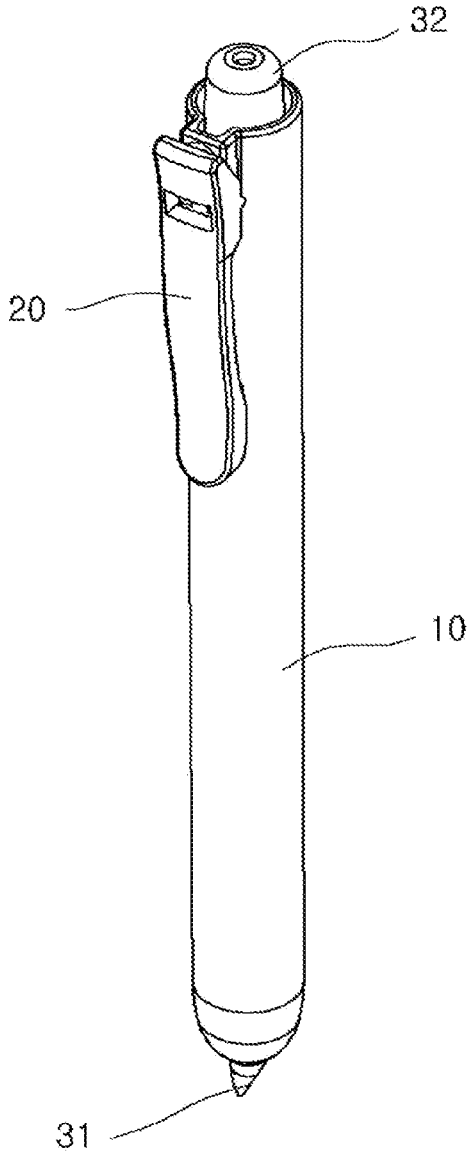
FIG. 2 is a perspective view showing an exposed state of the pen tip, in which the pen tip is exposed to the outside.
Figure 3:
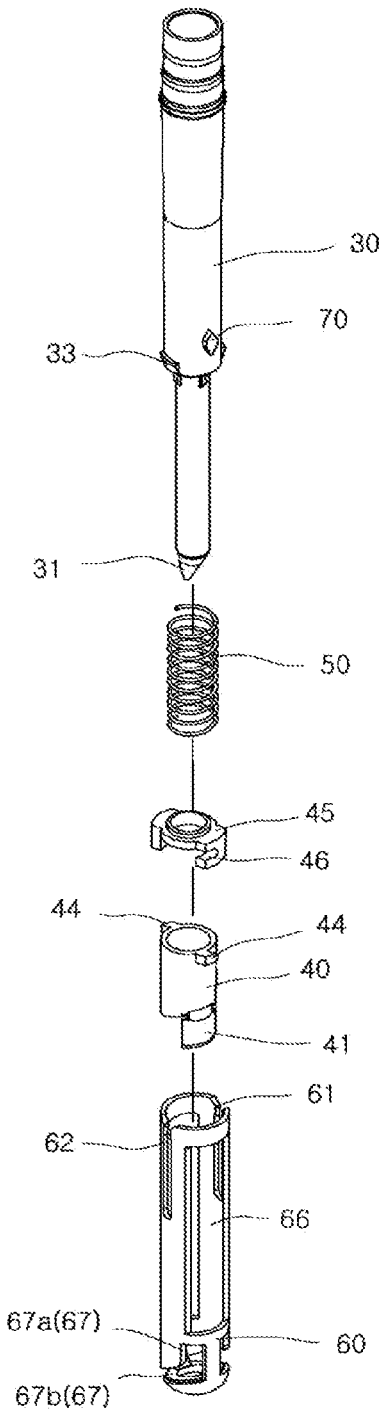
FIG. 3 is an exploded perspective view showing the principal constituent elements of the writing tool according to the present invention.

Hereinafter, embodiments of the present invention will now be described with respect to the configuration in detail with reference to the accompanied drawings.

A slide type writing tool having a device for preventing dryness according to the present invention is to make a pen tip using highly volatile ink of, for example, highlighters, markers, magic markers, plus pens or the like exposed to the outside only at the time of use but sealingly received inside at the time of non-use so as to prevent the evaporation of the ink and the dryness of the pen tip.

A pen housing 10 is formed in the shape of a cylinder with an empty inside portion and includes an ink holder 30 and a sealing member 40 having a dryness prevention function, both of which are received in the empty inside portion and a button clip part 20 provided on the outside thereof.

The ink holder 30 can be of an ink injection type for repetitive ink injection or an ink pack exchange type.

The pen housing 10 has a pen tip exit hole 11 formed at a front end thereof such that a pen tip 31 of the ink holder 30 can be exposed to the outside.

Further, the pen housing 10 has a button clip part 20 provided to the upper portion of the outside thereof, wherein the button clip part 20 can serve as a locking and unlocking device for maintaining the forwardly moved state and the backwardly moved state of the ink holder 30 by the clicking operation of the button clip part 20.

The ink holder 30 has a knob 32 exposed to the upper end portion of the pen housing 10, wherein a locking member can be provided to the knob 32 such that the knob 32 of the ink holder 30 can be locked or unlocked in response to the pressing of the knob 32 and such a locking member is well known in the art.

The ink holder 30 received in the pen housing 10 has the pen tip coupled to the front end side thereof and the knob 32 coupled to the other side, wherein the knob 32 can be detached from the ink holder 30 for injecting the ink or exchanging ink packs.

The ink holder 30 has a sealing member 40 provided to the front end thereof. Even though the pen tip 31 can come in and out of the sealing member 40, the sealing member 40 has a sealing function for preventing the dryness of the ink in a state, in which the pen tip 31 is received in the sealing member 40 at the time of non-use.

Figure 4:
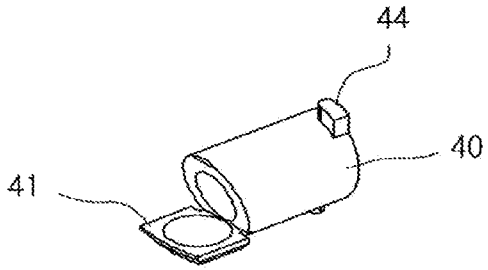
FIG. 4 is a perspective view showing the front end portion of a sealing member according to the present invention.
Figure 5:
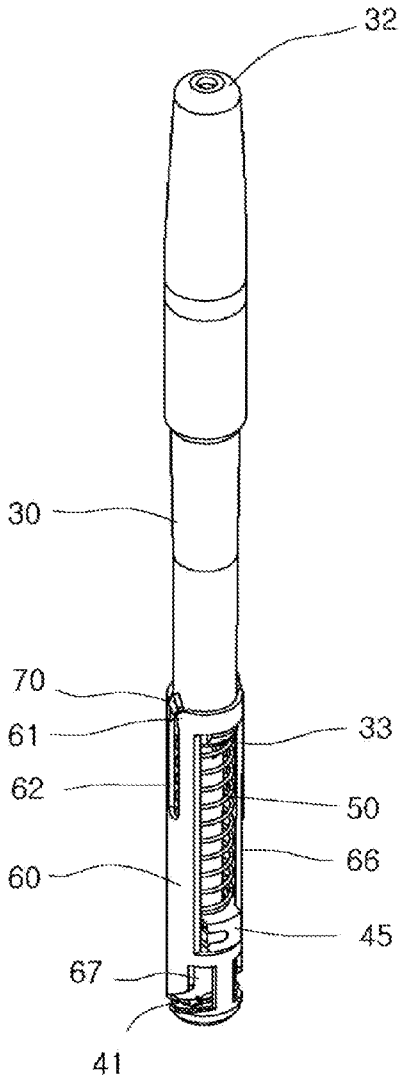
FIG. 5 is a perspective view showing the inside of a pen housing of the writing tool according to the present invention, in which the pen tip of the writing tool is maintained inside in a sealed state.
Figure 6:
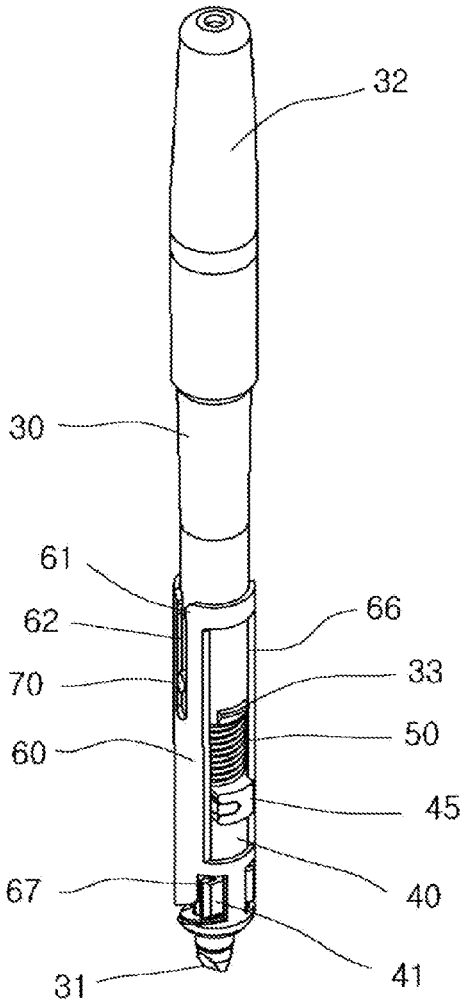
FIG. 6 is a perspective view showing the inside of the pen housing according to the present invention, in which the pen tip is exposed to the outside.
Figure 7:
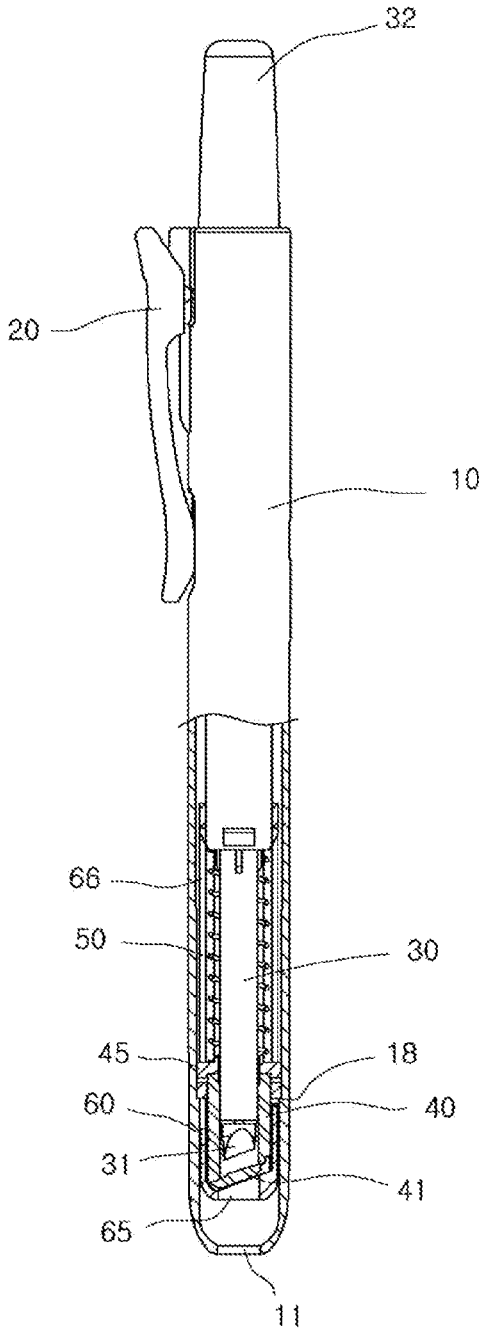
FIG. 7 is a partially taken cross-sectional view showing a state, in which the pen tip of the writing tool is maintained inside in a sealed state.
Figure 8:
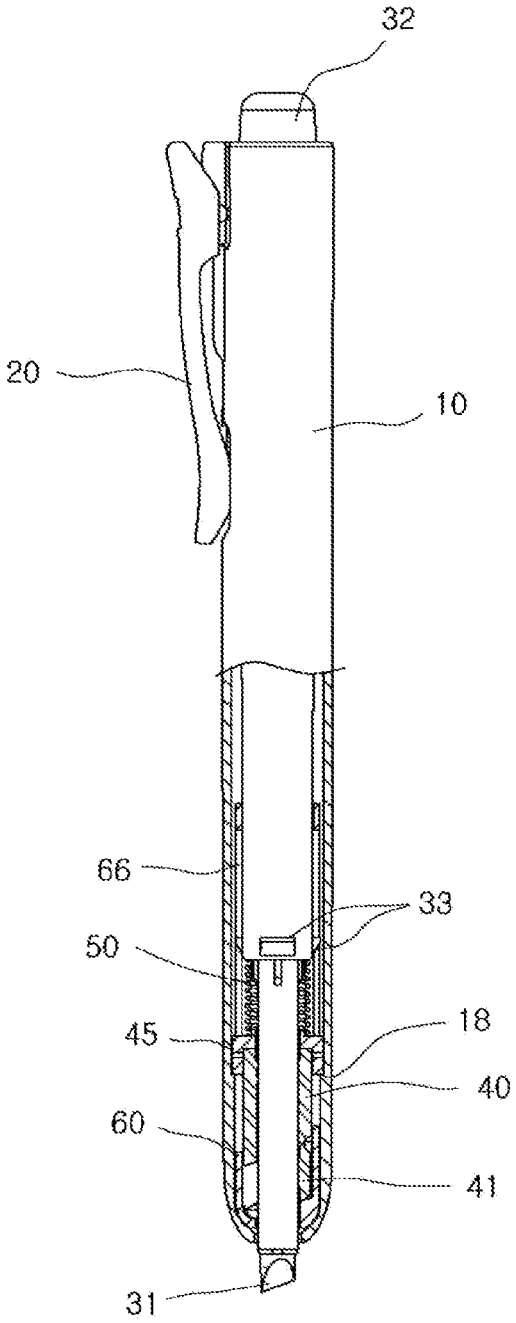
FIG. 8 is a partially taken cross-sectional view showing a state, in which the pen tip is exposed to the outside.

The sealing member 40 is provided with a cover 41 at the front end thereof, wherein the cover 41 is made from a flexible rubber material or a synthetic resin material and connected to the front end of the sealing member 40 with a hinge function. Therefore, the cover 41 is maintained in an open state in the approximately perpendicular direction to the body part of the sealing member 40 such that the cover 41 does not disturb the coming in and out of the pen tip 31 in a normal state as shown in FIG. 4.

The cover 41 is fitted into a cam groove 67 of a guide member 60 such that the sealing operation of the cover 41 is controlled by the forward and backward operations of the guide member 60.

The guide member 60 is made from a synthetic resin material in the shape of a cylinder with an empty inside portion and provided between the sealing member 40 and the pen housing 10.

Therefore, the guide member 60 moves in response to the forward and backward movements of the ink holder 30 in a state, in which the guide member 60 receives the sealing member 40, wherein the cover 41 is guided along the cam groove 67 and thus the opening and closing operations of the sealing member 40 are guided by the guide member 60.

Further, the guide member 60 has holding parts 61 and operation slits 62 provided to the outside surface thereof along the longitudinal direction and an operation hole 65 provided to the front end portion thereof so as to enable the coming in and out of the pen tip 31.

The ink holder 30 has cam protrusions 70 which are integrally formed on the outer peripheral portion thereof such that the cam protrusions 70 move the guide member 60 in a state, in which the cam protrusions 70 come into contact with the holding parts 61 of the guide member 60, such that the cam protrusions 70 move along the operation slits 62 of the guide member 60.

Therefore, while the pen tip 31 is covered by the cover 41, the cover 41 hinge-connected to the front end of the sealing member 40 is opened in response to the forward or backward operations of the ink holder 30 and the guide member 60.

Meanwhile, the sealing member 40 is made from a flexible rubber material and has protrusions 44 formed to protrude from the outer diameter portion thereof such that a fixing cap 45 to be held by a stepped portion 18 formed on the inside of the pen housing 10 is provided to the sealing member 40 in such a manner that the protrusions 44 of the sealing member 40 are received in receiving grooves 46 of the fixing cap 45.

A spring 50 is elastically provided between the fixing cap 45 coupled to the sealing member 40 and the ink holder 30.

Figure 11:
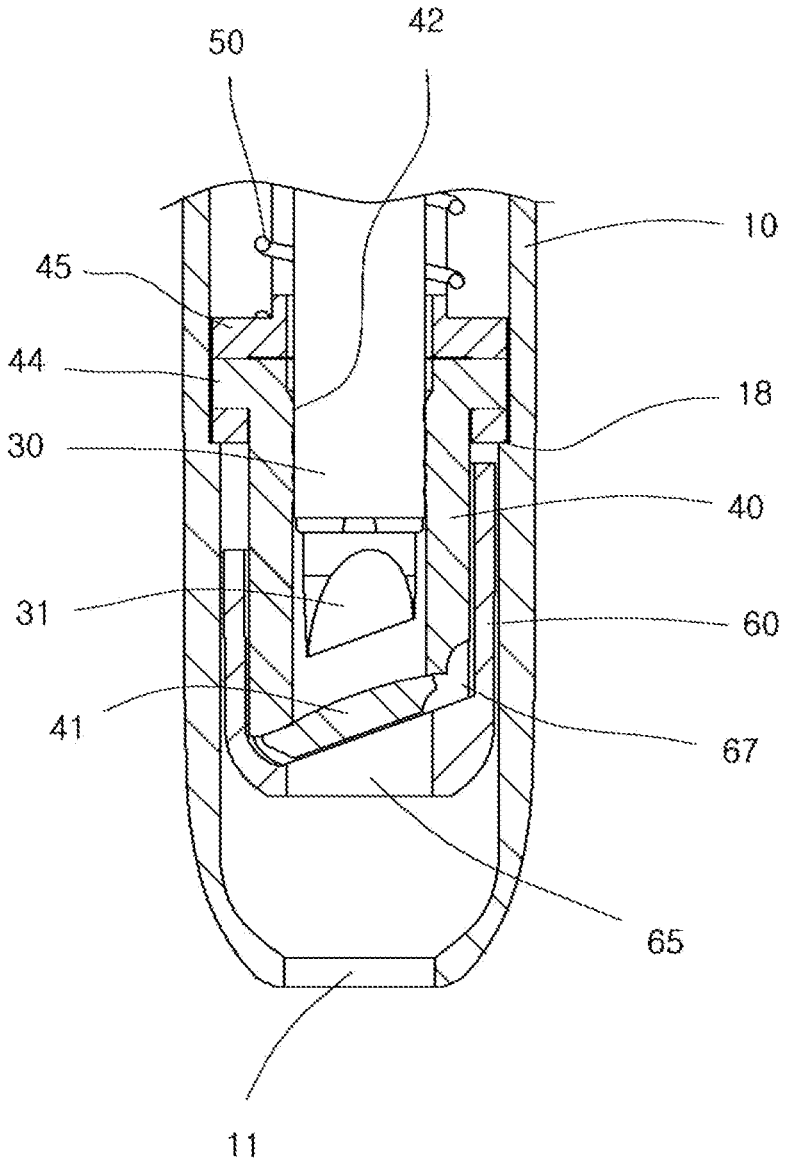
FIG. 11 is a partially taken expanded cross-section view of FIG. 7.

Therefore, if the cover 41 of the sealing member 40 is opened and then sealed back, the position of the cover 41 is restrained by the cam groove 67 through the backward movement of the guide member 60 such that the pen tip 31 is pulled back to be sealed, as shown in FIG. 11.

At this time, the ink holder 30 moves back together with the guide member 60, wherein the cover 41 of which position is restrained by the cam groove 67 due to the elastic force of the spring 50 provided between the fixing cap 45 and the ink holder 30 is elastically supported such that the close contact state with respect to the front end portion of the sealing member 40 can be maintained.

Figure 9:
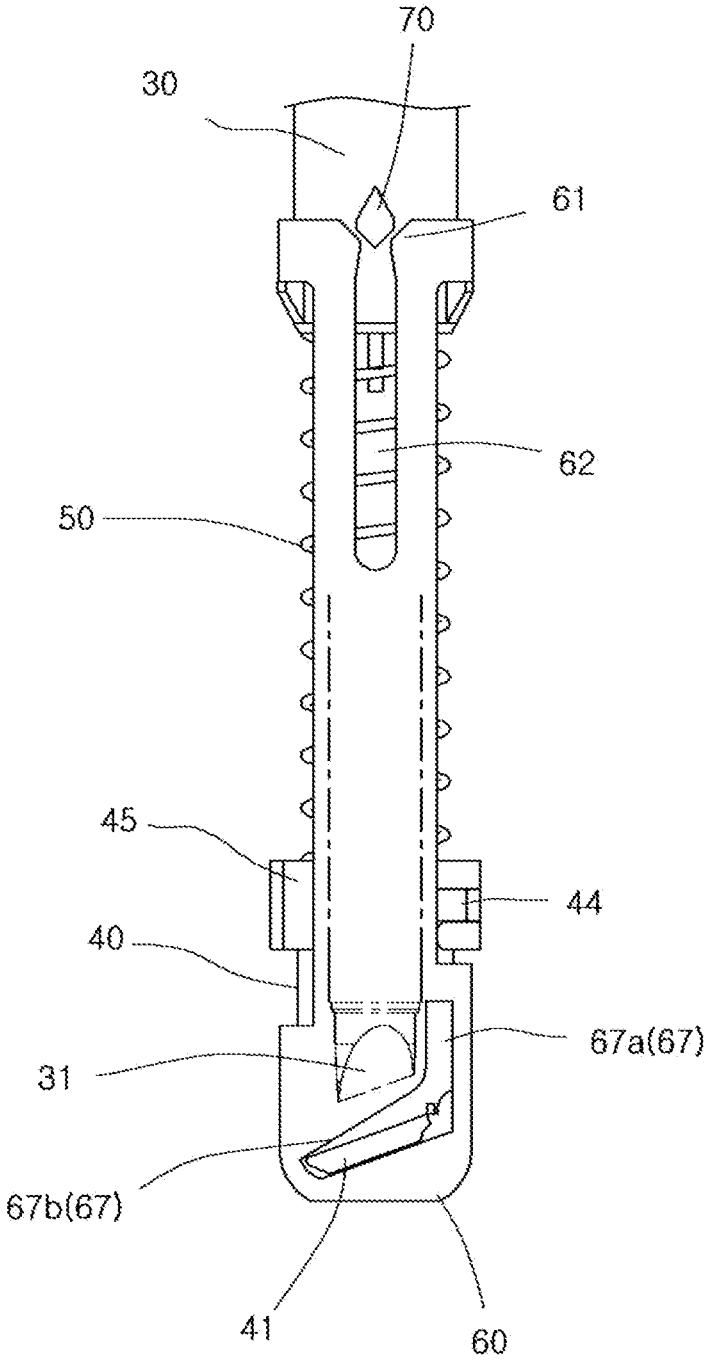
FIG. 9 is a front view showing the principal constituent elements of the writing tool according to the present invention, in which cam protrusions provided on an ink holder come into contact with the holding parts of a guide member so as to be pushed to move.
Figure 10:
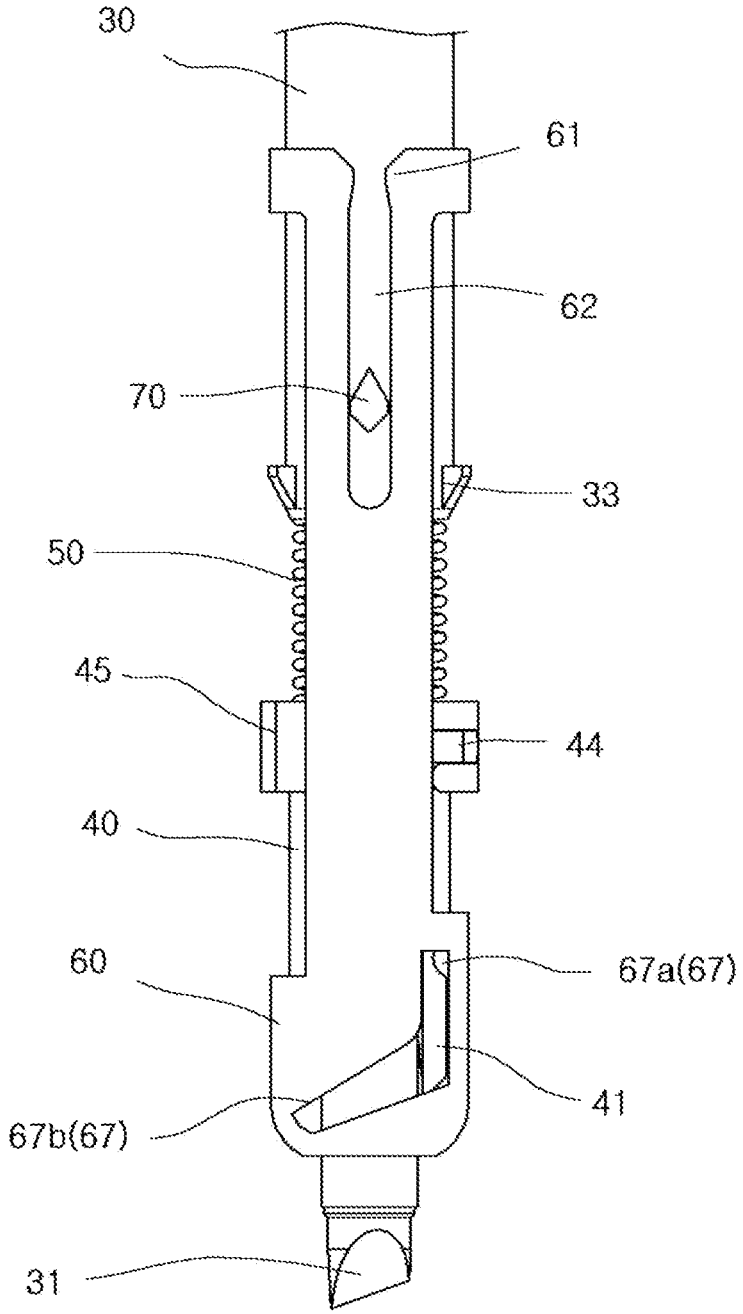
FIG. 10 is a front view showing the principal constituent elements of the writing tool according to the present invention, in which the cam protrusions are inserted into the operation slits of the guide member so as to move.

Further, the guide member 60 has the operation slits 62 formed to be long at one side or both sides of the guide member 60 along the longitudinal direction as shown in FIG. 9 and FIG. 10, and the holding parts 61 formed to protrude so as to make the paths of the operation slits 62 narrow.

Meanwhile, the ink holder 30 has the cam protrusions 70 integrally formed on the ink holder 30 so as to protrude from the outer periphery of the ink holder 30 at positions which come into contact with the holding parts 61 of the guide member 60.

According to the present invention as structured above, if the writing tool is not in use in a state, in which the ink holder 30 is received in the pen housing 10, the pen tip 31 is withdrawn and covered by the cover 41 in the sealing member 40 by the elastic force of the spring 50, thereby being sealed, as shown in FIGS. 1, 5, 7 and 11.

In order to protect the pen tip 31 in a completely sealed state, it is preferable to further provide a sealing portion 42 to the sealing member 40, wherein the sealing portion 42 is provided at the opposite side of the cover 41 on the inner diameter portion of the sealing member 40, as shown in FIG. 11, such that the sealing portion 42 protrudes from the inner diameter portion of the sealing member 40 so as to come into close contact with the outer diameter portion of the ink holder 30.

In this state, in order to expose the pen tip 31 out of the front end of the pen housing 10 so as to use the same, the button clip part 20 is operated or the knob 32 is clicked so as to operate the locking member (not shown), thereby making the ink holder 30 move forwards together with the sealing member 40.

At this time, the cam protrusions 70 protruding from the outer periphery of the ink holder 30 push and move the guide member 60 by a maximum distance in a movable range of the guide member 60, in which the guide member 60 can move while the holding parts 61 of the guide member 60 are in contact with the cam protrusions 70, that is, a distance that the guide member 60 comes into contact with the inside of the front end of the pen housing 10.

Further, the fixing cap 45 coupled to the sealing member 40 is held by the stepped portion 18 on the inside of the pen housing 10. Therefore, the body portion of the sealing member 40 cannot move while the cover 41 hinge-connected to the front end portion can be opened or closed according to the position of the cam groove 67 of the guide member 60.

The cam groove 67 has a linear portion 67*a* formed in parallel to the movement direction of the ink holder 30 and an inclined portion 67*b* extending from the liner portion 67*a* and pressing the cover 41 such that the cover 41 can come into contact with the front end of the sealing member 40

Therefore, if the guide member 60 comes into contact with the inside of the front end portion of the pen housing 10 and reaches a position at which the guide member 60 cannot move further, the cover 41 moves from the position of the inclined portion 67*b* to the linear portion 67*a* in the cam groove 67 such that the cover 41 becomes opened from the front end portion of the sealing member 40, as shown in FIG. 10.

At this time, the holding parts 61 which are in contact with the cam protrusions 70 spread out by the forward movement of the ink holder 30 and thus cam protrusions 70 enter into the positions of the operation slits 62 such that the pen tip 31 and the ink holder 30 continuously move forward and the pen tip 31 is exposed for writing, as shown in FIGS. 2, 6, 8 and 10.

In order to receive the pen tip 31 in the pen housing 10 so that the pen tip 31 is sealed, the button clip part 20 or the knob 32 is clicked for the conversion to an unlocking state through the operation of the locking member, and then the ink holder 30 and the pen tip 31 move backwards by the elasticity of the spring 50.

As the guide member 60 moves backwards, the cover 41 at the position of the linear portion 67*a* of the cam groove 67 is guided to the position of the inclined portion 67*b* so as to further move backward. Therefore, the pen tip 31 is received in the sealing member 40 and sealed by the cover 41 so as to be kept in a sealed state, as shown in FIGS. 9 and 11.

At this time, the cam protrusions 70 move backwards along the operation slits 62. At positions at which the guide member 60 is held by the sealing member 40 and cannot move backwards any more, the cam protrusions 70 make the holding parts 61 spread out further such that the cam protrusions 70 can move backwards further and then are returned to the initial positions thereof, as shown in FIG. 10.

The ink holder 30 has holding projections 33 and the guide member 60 has movement holes 66 at positions corresponding to the holding projections 33 of the ink holder 30 such that the ink holder 30 and the guide member 60 can be assembled with each other in a state, in which the ink holder 30 and the guide member 60 are prevented from escaping from each other and can move together.

By the above operations, the ink holder 30 and the pen tip 31 can be exposed for enabling writing or the ink holder 30 and the pin tip 31 are received in the pen housing 10 to be maintained in a sealed state for preventing the evaporation of the ink or the dryness of the pen tip.

Further, the structure of the slide type writing tool according to the present invention has a simple structure for reducing the manufacturing costs while extending the lifespan of the product without trouble, thereby improving reliability.

The embodiments described above are to be understood as a few illustrative examples of the present invention and the present invention is not limited to the embodiments and the drawings. It will be understood by those skilled in the art that various modifications, combinations and changes may be made to the embodiments without departing from the scope of the present invention.

What is claimed is:

1. A slide type writing tool, comprising:

a pen housing (10) formed in a cylindrical shape with an empty inside portion and having a pen tip exit hole (11) formed by penetrating a front end portion and a button clip part (20) provided to an upper end at one side;

an ink holder (30) received in the pen housing (10) so as to receive ink therein in a way such that a pen tip (31) is coupled at the front end thereof and a knob (32) is coupled to the other side thereof;

a sealing member (40) having a cover (41) hinge-connected to the front end thereof so as to be opened or closed according to the forward or backward movement of the ink holder (30) in a way such that the pen tip (31) of the ink holder (30) is covered by the cover (41), such that the pen tip (31) can come in and out;

a spring (50) elastically supporting the sealing member (40) and the ink holder (30); and a guide member (60) positioned between the sealing member (40) and the pen housing (10) and having an operation hole (65) penetrated so as to enable the pen tip (31) to come in and out in response to the forward or backward movement of the ink holder (30) in a way such that the sealing member (40) is received in the guide member (60), wherein the cover (41) of the sealing member (40) is guided in a way such that the cover (41) of the sealing member (40) is fitted into a cam groove (67) of the guide member (60) which is formed to extend from a linear portion (67*a*) to an inclined portion (67*b*), such that the opening and closing operations of the cover (41) are guided when the sealing member (40) moves, the guide member (60) has holding parts (61) and operation slits (62) provided to the outside surface thereof along the longitudinal direction thereof, the ink holder (30) has cam protrusions (70) for enabling the guide member (60) to move in a way such that the cam protrusions (70) come into contact with the holding parts (61) of the guide member (60), and moving along the operation slits (62), and the sealing member (40) has a sealing portion (42) formed to protrude inwards from an inner diameter portion thereof so as to come into contact with the outer diameter portion of the ink holder (30) and protrusions (44) formed to protrude outwards from an outer diameter portion thereof such that a fixing cap (45) to be held by a stepped portion (18) formed on the inside of the pen housing (10) is coupled to the sealing member (40) in such a manner that the protrusions (44) of the sealing member (40) are received in receiving grooves (46) of the fixing cap (45).

* * * * *